United States Patent [19]

Gay et al.

[11] 4,113,213

[45] Sep. 12, 1978

[54] MAIL BOX SUPPORT

[76] Inventors: Guy R. Gay; Neil Gay, both of P.O. Box A1, Weeks Mills, Me. 04361

[21] Appl. No.: 776,123

[22] Filed: Mar. 10, 1977

[51] Int. Cl.[2] ..... B65D 91/00

[52] U.S. Cl. ..... 248/128; 232/39; 16/152

[58] Field of Search ..... 248/222.1, 145, 130, 248/131, 517; 232/39; 403/176, 231, 109; 16/152

[56] References Cited

U.S. PATENT DOCUMENTS

| | | | |
|---|---|---|---|
| 519,427 | 5/1894 | Groff | 232/39 |
| 1,053,082 | 2/1913 | Yeakel | 248/128 |
| 1,893,729 | 1/1933 | Call | 248/222.1 |
| 1,915,479 | 6/1933 | Smith | 248/222.1 |
| 2,050,573 | 8/1936 | Kammerich | 232/39 |
| 2,149,050 | 2/1939 | Hajicek | 232/39 |
| 3,881,650 | 5/1975 | Schmidt | 232/39 |

*Primary Examiner*—Roy D. Frazier
*Assistant Examiner*—Peter A. Aschenbrenner
*Attorney, Agent, or Firm*—William Nitkin

[57] ABSTRACT

An improved mail box support device comprised of an arm having a first and second end with means to support a mail box at the first end thereof and having means at its second end to be rotatably mounted on a shaft supported on a post, the arm being bent at an angle near its second end and the shaft extending from the post at the same angle as the arm is bent so that when the mail box is struck by a moving object, it rotates out of the moving object's path.

1 Claim, 4 Drawing Figures

MAIL BOX SUPPORT

BACKGROUND OF THE INVENTION

The device of this invention relates to mail box supports and more particularly relates to mail box support post systems which include means for the lateral movement of the mail box during contact with a moving object in order to prevent damage that might otherwise occur to the mail box if it were in a fixed position.

It is well-known in the art of mounting mail boxes by the roadside that they can be affixed in such a way as to swing to the side when struck by a motor vehicle or other moving object. These supports usually allow the mail box to return to its central position for receipt of mail. This lateral movement is especially important in rural areas where mail boxes may be struck by snow plows or other types of vehicles and without which lateral movement the mail boxes would be severely damaged.

SUMMARY

The device of this invention consists of an improved mounting post with means for lateral pivoting of the mail box and adjustment means for setting the extension and height of the mail box in relation to the road. The device of this invention allows the mail box when struck by a moving object to move laterally upwards to the side and even to rotate up to 360° thereby allowing the moving object, such as a snow plow or farm vehicle which might not necessarily take adequate precautions to avoid hitting the mail box, to pass by. The device of this invention further allows for the mail box to be extendible into the roadway and adjustable in height so as to conform to the height and reach of the postman as he delivers the mail making it easier for him to insert the mail into the mail box.

The objects of this invention will become clearer when reference is made to the following drawings and descriptions thereof.

DESCRIPTION OF THE PREFERRED EMBODIMENT

Figure 1:
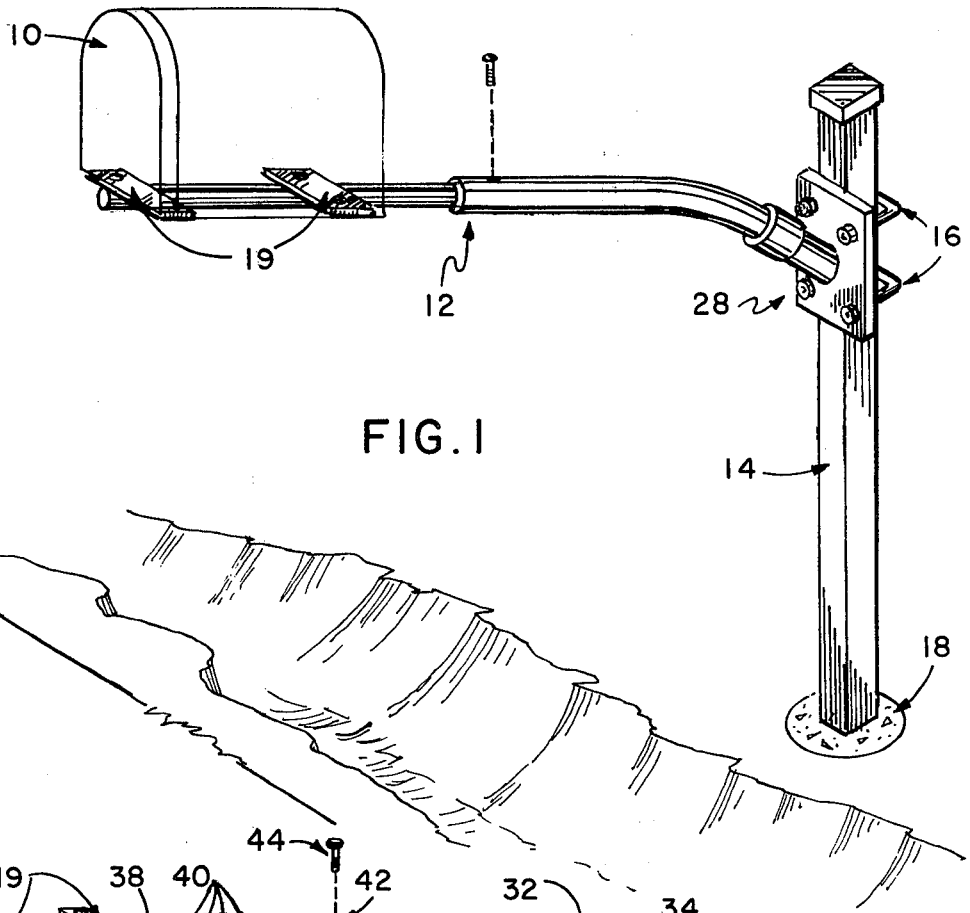
FIG. 1 illustrates a perspective side view of the device of this invention with mail box mounted thereon.

FIG. 1 illustrates a perspective side view of the device of this invention in use with reference to a road. Mail box 10 in outline form seen mounted on the device of this invention can be any standard mail box or equivalent mail receptacle. Mail box 10 is mounted on arm 12 which is affixed to support post 14 by one or more clamps 16. Arm 12 has at one end or more box mounting brackets 19 to which mail box 10 is affixed by nuts and bolts or equivalent means. Support post 14 is embedded into the ground within support post bed 18 which can be a cement bed or equivalent adapted to hold support post 14 in a perfectly vertical position. It is important that the support post 14 be perfectly vertical for if it is mounted at an angle from the vertical, the device of this invention may not function properly. The height of support post 14 should be sufficient to allow arm 12 to be mounted thereon at least 36–44 inches above the shoulder of the road. It should be noted that other heights can be utilized depending upon the needs of the postman; and arm 12 can be moved upwards or downward by loosening the bolts of clamps 16, repositioning the arm to the desired height, and then retightening the bolts.

Figure 2:
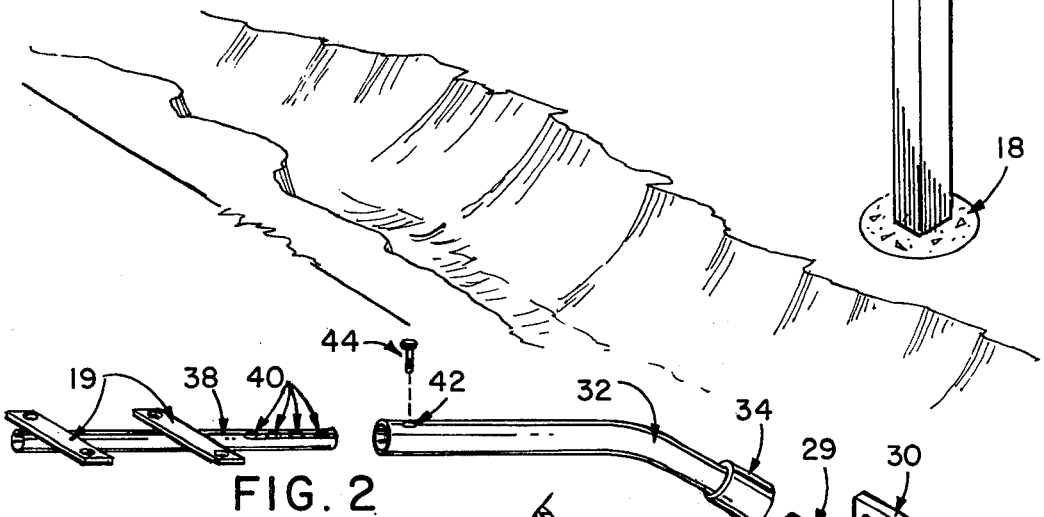
FIG. 2 illustrates a perspective side view of the arm and shaft bracket in a disassembled and extended mode.
Figure 3:
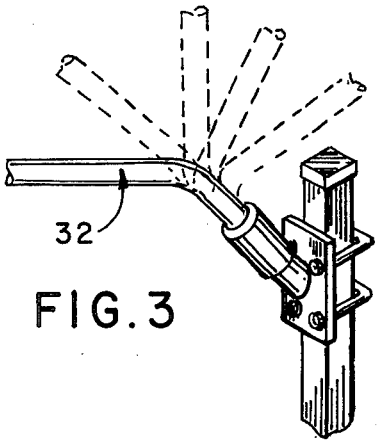
FIG. 3 shows a perspective side view of the arm illustrating its rotational movement.
Figure 4:
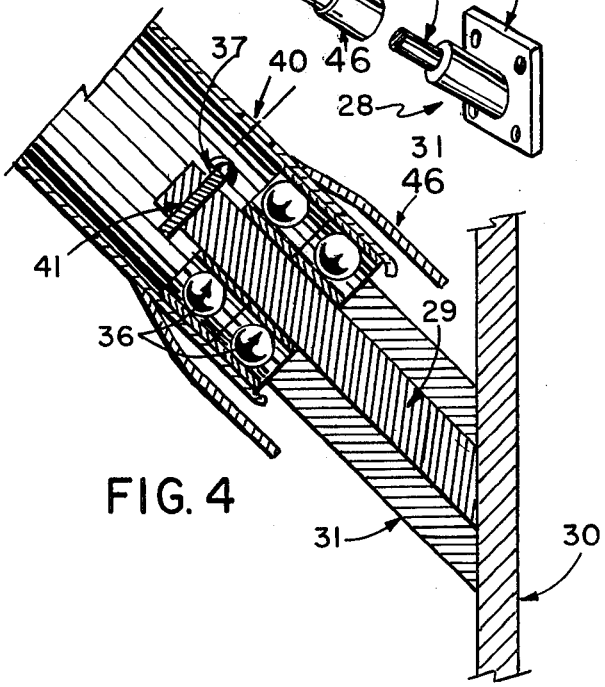
FIG. 4 illustrates a cross-sectional view through the shaft receipt member and shaft bracket.

FIG. 2 illustrates a perspective side view of arm 12 and shaft bracket 28 in a disassembled and extended mode for illustrative purposes. Seen in this view are box mounting brackets 19, which can be in a variety of configurations to fit different mail boxes, which can be welded or attached by equivalent means to arm extension 38. Arm extension 38 also contains a plurality of arm extension apertures 40 defined therein. Arm extension 38 is adapted to slide into hollow arm base 32. Arm base 32 and arm extension 38 in the mode illustrated can be constructed of steel or other equivalent material. Arm base 32 has located therein aperture 42 for receipt of screw 44. Arm extension 38 is slid into the hollow of arm base 32 until the desired arm extension aperture 40 is located in line with arm base aperture 42. Screw 44 is then inserted through arm base aperture 42 and tightened into arm extension aperture 40 of arm extension 38. It should be noted that by selecting different arm extension aperture, one can extend the length of arm 12 as desired. At the opposite end of arm base 32 from the arm base aperture the arm base is bent at an angle which can be 45° and terminates with a shaft receipt member 34. Shaft receipt member 34 can be comprised of a casing and one or more ball bearings 36, as illustrated in FIG. 4, which are permanently affixed to the inside of the shaft receipt member by tight concentric fit and crimping of the shaft receipt member, welding, or equivalent means. FIG. 4 illustrates a cross-sectional view through shaft receipt member 34 and shaft bracket 38 more clearly showing an embodiment having two ball bearings 36 with shaft 29 extending out of shaft collar 31 into the shaft receipt member. Also seen in this view is pin 37 which is shown inserted through pin entry aperture 40 in arm base 32 and into pin aperture 41 defined in shaft 29. The pin protrudes from the sides of shaft 29 and prevents the arm, once pin 37 is inserted, from being removed from shaft bracket 28. The shaft bracket's back plate 30 is mounted to support post 14 as described above. FIG. 3 illustrates arm 32 in outline form at a plurality of positions once it is rotated out of its resting horizontal mode.

Arm base collar member 46 seen in exterior view in FIG. 2 and more clearly illustrated in the cross-sectional view of FIG. 4 is affixed by welding or other equivalent means surrounding the shaft receipt member 34 and is adapted to extend toward the back plate member 30 so that it covers, surrounds, and protects the junction between the shaft collar 31 and the shaft receipt member 34 to prevent ice from forming or other foreign debris from entering therebetween. It should be further noted that back plate member 30 can be mounted horizontally as well as vertically and that when back plate member 30 is in the horizontal mode, arm base 32 operates in substantially the same manner as when back plate member is in the vertical mode.

It should be noted that when arm 12 swings out of the way after being struck by a moving object, it swings in an upward arc so that when it loses contact with the moving object, it returns to its lowest position by the force of gravity which is its horizontal position for normal usage. It has been found that when the device of this invention is constructed out of steel or equivalent material, its weight will prevent movement of the arm during normal wind conditions or other minor lateral pressures against the mail box, but that it will swing out of the way when a more significant force such as a motor vehicle makes contact with the unit.

Although the present invention has been described with reference to particular embodiments, it will be apparent to those skilled in the art that variations and modifications can be substituted therefor without departing from the principles and spirit of the invention.

We claim:

1. An improved mail box support arm device for affixation to a support post comprising:

a tubular arm base having a first and second end;

a tubular arm extension having a first and second end, said first end adapted to be slideably inserted within the first end of said arm base and affixed in a selected one of a plurality of positions to said arm base;

mail box mounting means positioned at the second end of said arm extension;

a shaft receipt member positioned within said arm base at its second end, said arm base being bent at a substantially 45° angle in proximity to said shaft receipt member, said shaft receipt member including at least one ball bearing member affixed therein and said arm base further having defined therein in proximity to said shaft receipt member a pin entry aperture;

a back plate member having defined therein at least one aperture for receipt of means to affix said device to a support post;

a shaft having a first and second end, the second end of said shaft extending from said back plate member at a substantially 45° angle, and having a shaft aperture defined laterally therethrough near its first end, said shaft's first end being inserted into said ball bearing member;

a shaft collar member surrounding a portion of said shaft in the vicinity of the second end of said shaft;

a pin member adapted to be inserted through said pin entry aperture in said arm base and into said shaft aperture so as to hold said arm base to said shaft; and an arm base collar member affixed to said arm base surrounding said shaft receipt member and extending so as to surround and cover the area of contact between said shaft collar member and said shaft receipt member.

* * * * *